US005649614A

United States Patent [19]

Kovens

[11] Patent Number: 5,649,614

[45] Date of Patent: Jul. 22, 1997

[54] MERCHANDISE CHUTE SHIELD FOR COIN ACTUATED BULK VENDING MACHINES

[75] Inventor: Steven A. Kovens, Reistertown, Md.

[73] Assignee: Parkway Machine Corporation, Timonium, Md.

[21] Appl. No.: 541,261

[22] Filed: Oct. 12, 1995

[51] Int. Cl.[6] ..... G07F 11/44

[52] U.S. Cl. ..... 194/344; 194/350

[58] Field of Search ..... 194/236, 237, 194/255, 292, 344, 350; 221/203, 265

[56] References Cited

U.S. PATENT DOCUMENTS

| | | | |
|---|---|---|---|
| 910,246 | 1/1909 | Travis | 194/255 |
| 2,772,811 | 12/1956 | Schaef | 221/155 |
| 2,880,906 | 4/1959 | Probasco | 221/203 |
| 3,018,148 | 1/1962 | Probasco . | |
| 3,036,732 | 5/1962 | Schaef | 221/113 |
| 3,260,338 | 7/1966 | La Barge . | |
| 3,430,746 | 3/1969 | Bolen . | |
| 3,604,547 | 9/1971 | Bolen . | |
| 3,804,294 | 4/1974 | Householder | 221/154 |
| 4,534,492 | 8/1985 | Schwarzli | 221/203 |
| 5,111,928 | 5/1992 | Kovens | 194/292 |
| 5,131,519 | 7/1992 | Ra | 194/350 |

*Primary Examiner*—F. J. Bartuska

*Attorney, Agent, or Firm*—Beveridge, DeGrandi, Weilacher & Young, LLP

[57] ABSTRACT

A shield for a merchandise chute of a coin-operated bulk vending machine for minimizing coin mechanism jamming due to accumulation on the upper shield surface where the shield features a downwardly sloped cover portion incorporating a coin channel for deflecting coins dropped thereon away from the shield and into the vending machine base.

19 Claims, 3 Drawing Sheets

FIG. 5
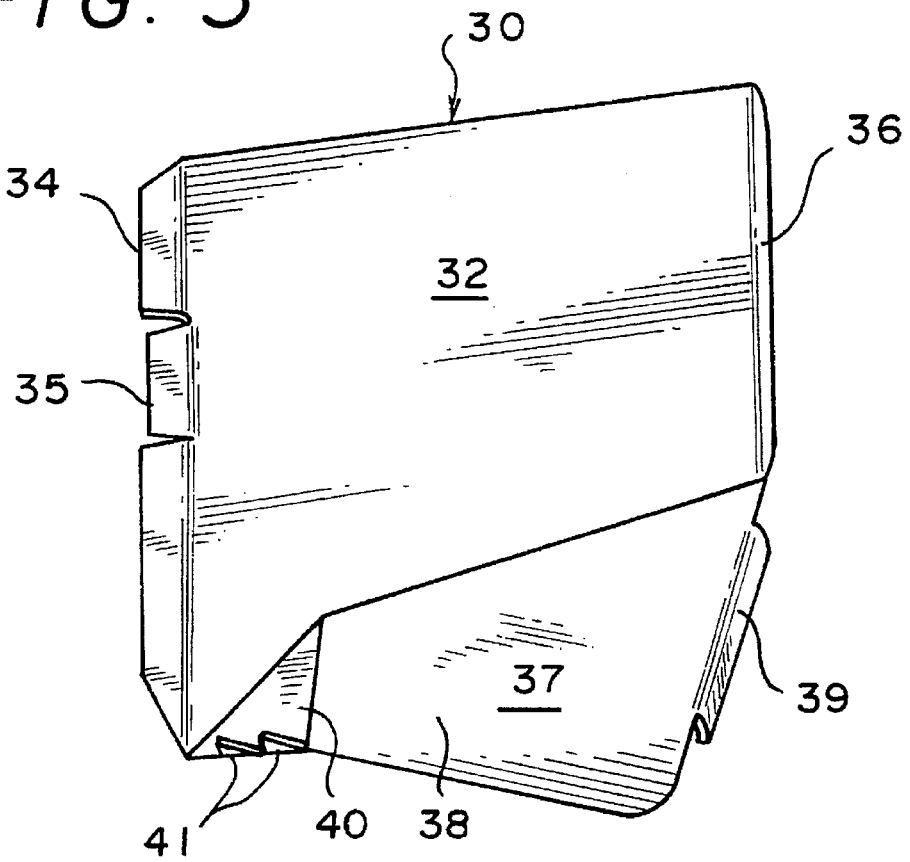
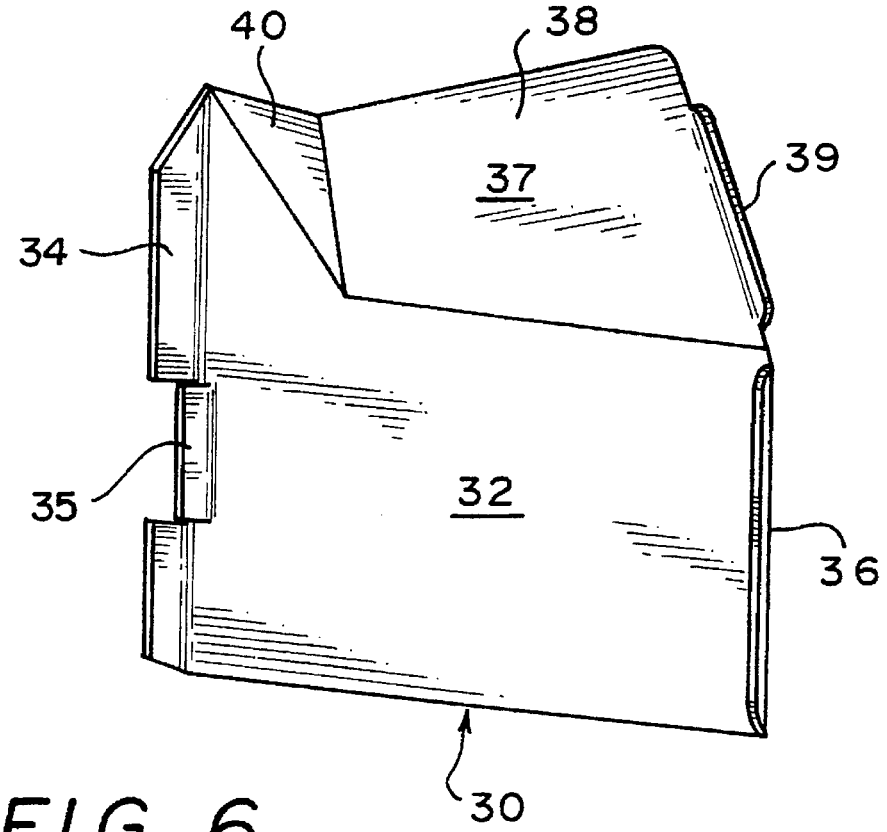
FIG. 6

MERCHANDISE CHUTE SHIELD FOR COIN ACTUATED BULK VENDING MACHINES

TECHNICAL FIELD

The present invention is directed to an expedient for limiting coin-actuated bulk vending machine failure attributable to jamming due to accumulation of coins on the top of a chute shield. More particularly, the invention concerns a coin directing section formed in a merchandise chute shield positioned behind and under an associated coin receiving mechanism of the bulk vending machine.

BACKGROUND OF THE INVENTION

The prior art is depicted in FIGS. 1–4. A coin-operated bulk vending machine 10 features conventional crank-handle operation and are commonly used as dispensing machines for encapsulated toys and candy. Such machines are typically placed near the front of retail outlets such as grocery stores and may be grouped in multiples on racks. One type of conventional coin-operated bulk vending machine features a coin receipt mechanism 14 and merchandise chute opening cover 18 secured in over-and-under arrangement on the front of a box-like base 12.

An over-and-under machine is typified by a plastic or glass globe for holding merchandise that is sealed with a locking lid. The globe is set on and supported by the metal or plastic base 12. A merchandise wheel for selecting a discrete quantity of merchandise is disposed between the top opening in the base and the bottom of the merchandise container and is operably connected to a crank-operated 16 coin receiving mechanism 14 is set into the base. A merchandise chute 20 is secured below the merchandise wheel and establishes a unitary channel-like passage/raceway 21 extending from the merchandise wheel to the bottom opening formed in the base 12. The lower end of the raceway 21 of the merchandise chute 20 terminates at the lower opening in the base and commonly features a groove adapted to receive the peripheral lip of the opening to secure the chute to the base.

The merchandise chute raceway 21 typically defines a curved or bent channel with a substantially vertical upper segment 24 juxtaposed relative to the back of the coin receiving mechanism and a less vertical/more horizontal lower segment 26 angling toward the lower opening in the front of the base. Side walls 25 provide the legs of the generally U-shaped cross-sectional configuration of the chute 20.

The opening of the merchandise chute 20 is covered with a chute shield/cover 22 to prevent merchandise from falling out of the raceway 21 into the base and to prevent coins discharged from the back of the receiving mechanism 14 from falling directly into the chute. Without the shield 22, discharged coins used to actuate the machine would fall directly into the chute and be dispensed with the merchandise. Thus, the shield 22 serves the dual purpose of confining dispensed merchandise within the channel 21 and to deflect coins discharged from the mechanism.

Structurally, the chute shields 22 typically define a bi-planar or continuously curved surface determined by the contours of the underlying chute and are formed of an appropriate material, e.g., stamped metal or molded thermoplastic resin. The chute shield is secured to the chute by frictional engagement from overhanging ledges 28 that set on the walls 25 of the chute 22. The frictional engagement is enhanced by the tang 29 which lodges against the inner portion of the wall 25 co-acting with the wall edge to provide for easy installation and removal and, therefore, easier maintenance and cleaning.

In the context of operation, once a coin of proper denomination is introduced into an over-and-under coin operated bulk vending machine 10 and the crank handle 16 rotated, the merchandise wheel rotates to dispense a discrete quantity of merchandise from the globe by gravity feed into the upper portion of the merchandise chute 20. The merchandise falls into the raceway 21 and is communicated from the wheel to the opening in the base by the chute. Coincidentally, the coin(s) used to actuate the machine, falls from the coin discharge in the back of the mechanism 14, onto the chute shield 22 and, ultimately, into the base. Occasionally, due to the close proximity of the upper surface of the chute shield 22 to the coin discharge area, frictional forces overcome the momentum of the coin and it lodges on the shield instead of falling into the base. A coin at rest on the top of the chute shield can prevent proper discharge of subsequently discharged coins. Thus, coins accumulate on the upper chute shield surface, eventually blocking coin discharge from the coin mechanism and jamming the machine rendering the machine inoperable. An inoperable machine may remain undetected in that condition for days until inspected by the operator in the course of routine maintenance and collection. Therefore, not only does a broken machine constitute a maintenance inconvenience but also it reduces the operator's cash flow and creates an economic loss. Clearly, an operator whose livelihood depends on the proper operation of vending machines will suffer an unnecessary economic loss occasioned by the jamming problem.

SUMMARY OF THE INVENTION

Thus, it is an object of the present invention to overcome the identified coin jamming problem in the prior art coin operated bulk vending machines.

Other objects of this invention are to provide a merchandise chute shield designed to minimize accumulation of coins on the shield and jamming of the coin receiving mechanism.

A further object of this invention is to provide a novel merchandise chute cover which can be provided on original coin operated bulk vending machines and is easily retrofittable for use on existing machines.

Still further objects of this invention are to provide a convertible or unitary molded chute shield preferably formed from molded thermoplastic which possesses sufficient strength to resist wear and retain its structural integrity in the field.

These and other objects are satisfied by a merchandise chute shield, comprising:

a first vertical shield cover portion, said first shield cover portion lying in a first, substantially vertical plane and defining an upper edge, two oppositely disposed side edges, and a lower edge;

a second shield cover portion element said second shield portion angularly connected to said first section and lying in a second plane which intersects the first plane at said lower edge at an obtuse angle, a coin discharge guide lying in a third plane angularly connected to both of said first and second sections and disposed at an angle different from the angular connection of said first and second planes, said coin discharge guide having a first, a second, an a third edge, said first guide edge abutting the lower edge of said first shield guide and a second guide edge joining the second shield portion and said coin discharge, said coin discharge guide defining a planar element descending from the second plane at an acute angle.

The invention embodies an elegant solution to one cause of the vexing problem of coin mechanism jamming. The invention provides a custom configured shield for the vending machine merchandise chute in order to prevent coin mechanism jamming due to accumulation on the upper shield surface. The idea behind the invention is a simple concept. It provides a coin discharge guide formed integrally with the chute shield for directing coins away from the back of the coin receiving mechanism and into the base.

In basic terms, the fundamentals of the invention is grounded in elementary mechanics and, more particularly, the laws of the inclined plane. Assuming the friction component is minimized as the coin slides down and off of the shield, the velocity of the coin during discharge is a proportional product of acceleration and the angle of decline from planar or $$v=v_o\pm(g \sin B)t$$

where g=acceleration, B=angle of inclination, and t=time. It should be readily appreciated that as the angle B increases, the ultimate velocity of the coin increases during discharge which reduces the probability of the coin succumbing to frictional forces and, therefore, stopping on the shield.

The invention herein is particularly suited for use with such coin operated bulk vending machines as the PM Elite, the PN95, manufactured by Parkway Machine Corporation and even fits older machines.

Given the following enabling description of the drawings, the inventive merchandise chute cover for coin actuated bulk vending machines of the invention should become evident to a person of ordinary skill in the art.

BRIEF DESCRIPTION OF THE DRAWINGS

FIG. 5 is a front view of an embodiment of a merchandise chute cover according to the invention.

FIG. 6 is a rear view of the embodiment of FIG. 5 according to the invention.

DETAILED DESCRIPTION OF THE PREFERRED EMBODIMENT

Figure 1:
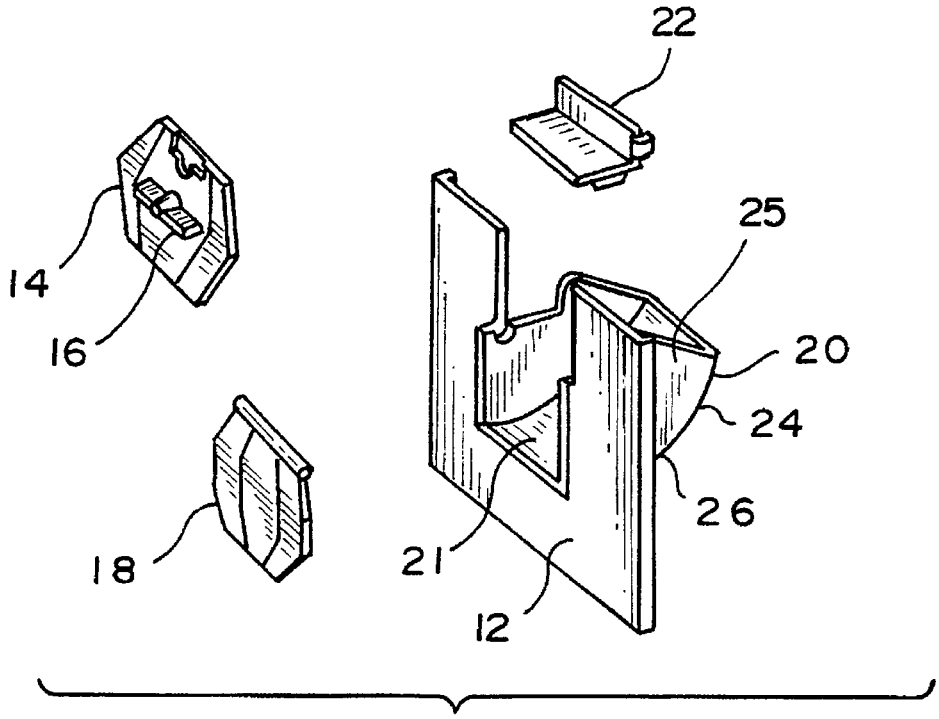
FIG. 1 PRIOR ART
FIG. 1 is a exploded view of a prior art coin mechanism, merchandise chute assembly for a coin operated bulk vending machine.
Figure 2:
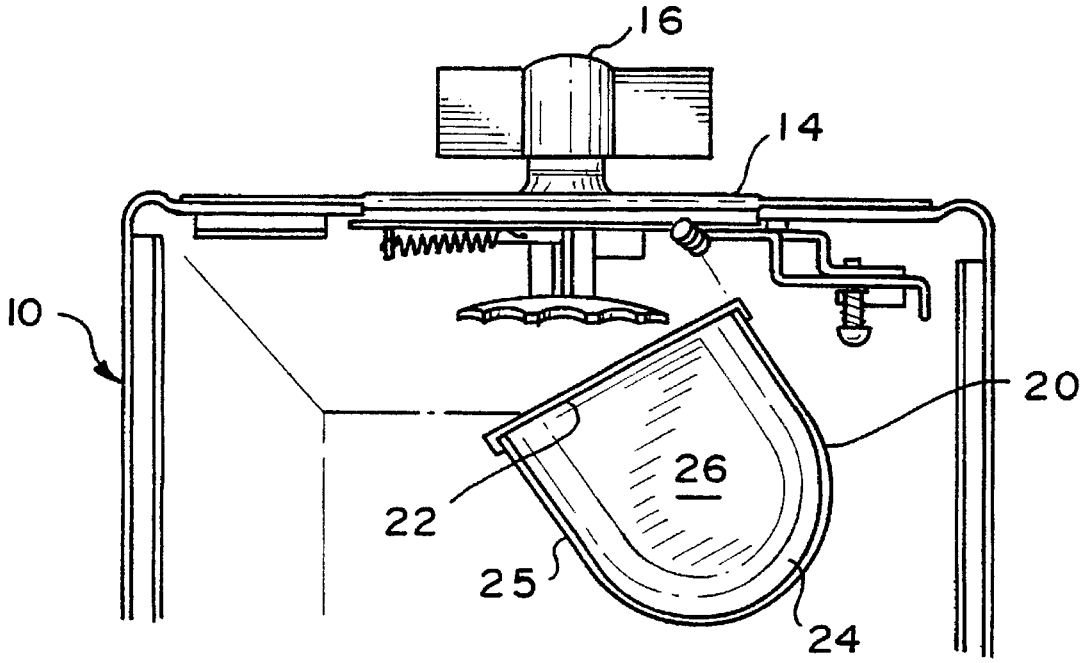
FIG. 2 PRIOR ART
FIG. 2 is a top view of a prior art coin mechanism and merchandise chute/chute cover assembly affixed in the machine base.
Figure 3:
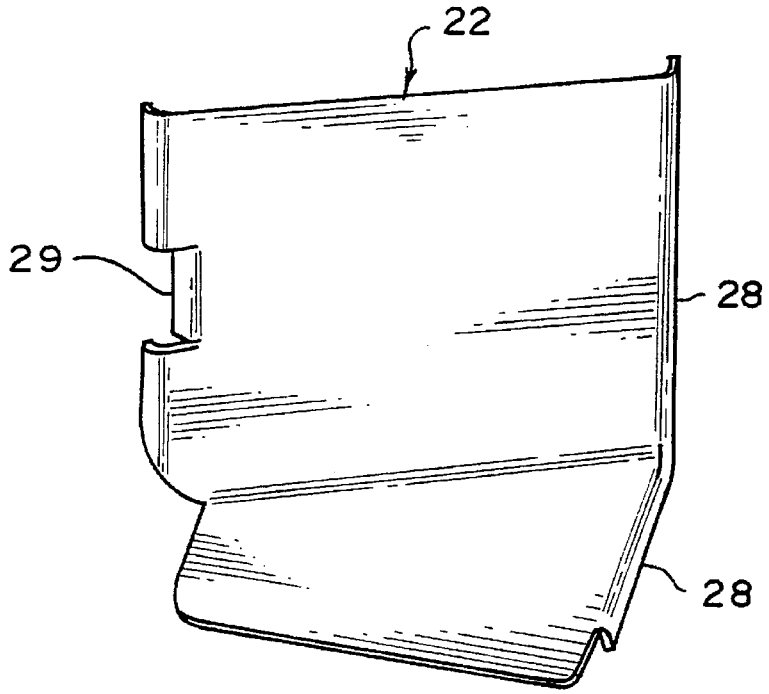
FIG. 3 PRIOR ART
FIG. 3 is a front view of a prior art merchandise chute cover.
Figure 4:
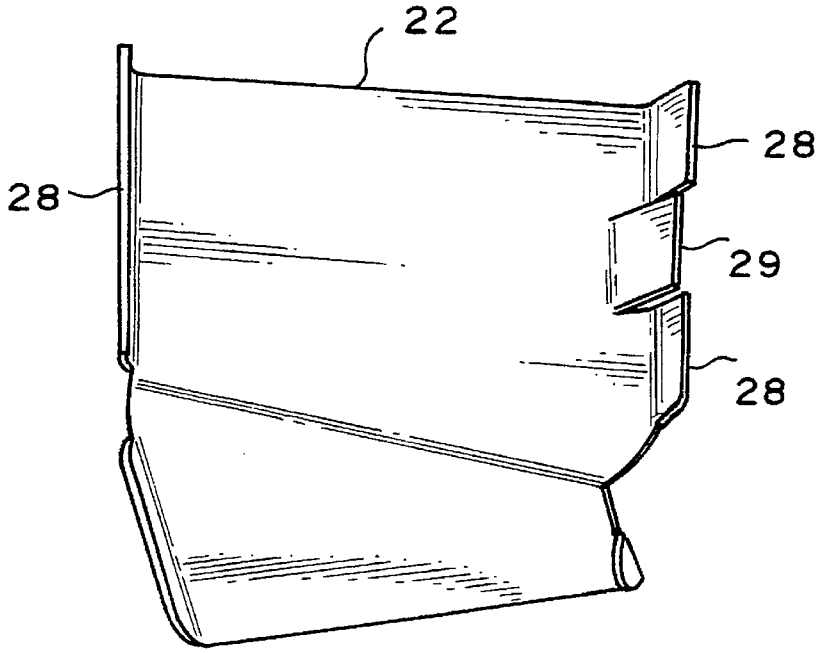
FIG. 4 PRIOR ART
FIG. 4 is a rear view of a prior art merchandise chute cover.

FIGS. 5 and 6 depict an embodiment of a merchandise chute shield 30 according to the invention, formed from metal or an appropriately strong and rigid polymer resin such as polystyrene, high density polyethylene, etc. The inventive chute cover 30 provides a substantially vertical planar portion 32 with a width slightly greater than the width of the chute 20 and which is adapted to cover the descending vertical portion of the chute. Generally coextensive with the vertical edges of planar portion 32, a pair of gripping ledges 34 and 36 project rearwardly from the planar surface. These ledges are dimensioned to register with the outer wall of the chute 20. Also to insure satisfactory gripping, the invention incorporates a tang 35 comprising a section of ledge 34, angularly offset therefrom in a manner to slidingly receive and frictionally grip the edge of chute wall 25. As illustrated, the ledge 34 and the tang 35 diverge at an acute angle relative to the plane defined by the portion 32. In this manner, the illustrated shield 30 accommodates a merchandise chute which is off-set, not normal (square) to the front of the machine base 12.

The lower portion 38 of the shield 30 is defined by bifurcated descending/sloped portions 37 and 38. Both of these sloped portions join the upper shield portion 32 and project at an obtuse (more than 90°) angle or, in other words, a descending acute angle. The sloped portion 37 lies substantially in a plane that corresponds to the angle of descent of the underlying raceway 21 comprising the lower portion of the merchandise chute 20. A descending ledge 39, fashioned similarly to ledge 36, is adapted to lie over the edge of the wall 25 of the chute 20 in a manner where the sloped portion 37 lies securely over the chute.

The coin deflecting guide channel 40 is joined along the side of sloped portion 37 opposite that of the ledge 39. The coin channel 40 triangulates to a point underlying the bottom of the junction of the vertical ledge 34 and planar portion 32. The coin discharge guide channel 40 overlies a portion of the merchandise chute and has common edges with both planar section 32 and sloped portion 37. It slopes downwardly from portion 37 at an acute angle to establish a steeper section (more sharply angled). The third edge of the triangular guide 40 features two upwardly projecting sawtooth-like wall portions 41. The wall portions 41 project at an obtuse angle from the upper surface of the plane defined by the guide 40 but do not extend above the plane defined by the sloped portion 37. Thus, a coin channel is defined that directs discharged coins into the machine base and away from upper surface of the sloped portion 37. Consequently, the likelihood of coins becoming stuck on the chute shield is reduced.

The chute cover 30 described herein is particularly suitable for use with over-and-under style units but are not limited in use thereto.

The sloped portion 37, alternatively, may possess a continuously curved, convex upper surface to promote discharge of the coins. Another variation contemplates removable attachment means as a substitute for friction/gravity seating of the shield on the chute (using screws, pins, and the like). Such attachment means could be formed as part of the shield during molding and may increase tamper resistance by providing a reinforced mechanical linkage between the shield and the underlying merchandise chute.

Given the foregoing, variations and modifications to the invention should now be apparent to a person having ordinary skill in the art. These variations and modifications are intended to fall within the scope and spirit of the invention as defined by the following claims.

I claim:

1. A merchandise chute shield for a coin-operated vending machine, comprising:

a first vertical shield cover portion, said first shield cover portion lying in a first, substantially vertical plane and defining an upper edge, two oppositely disposed side edges, and a lower edge;

a second shield cover portion element, said second shield portion angularly connected to said first section and lying in a second plane which intersects the first plane at said lower edge at an obtuse angle, a coin discharge guide lying in a third plane angularly connected to both of said first and second sections and disposed at an angle different from the angular connection of said first and second planes, said coin discharge guide having a first, a second, an a third edge, said first guide edge abutting the lower edge of said first shield guide and a second guide edge joining the second shield portion, said coin discharge guide defining a planar element descending from the second plane at an acute angle.

2. The merchandise chute shield according to 1 where the outline of the second portion and the coin discharge guide define a generally right triangle where the hypotenuse is coextensive with and abuts the lower edge of said first portion.

3. The merchandise chute shield according to 2 where the first portion, the second portion, and the coin discharge guide are formed as a one piece molded thermoplastic structure and said first portion includes means for securing the merchandise chute shield to the merchandise chute.

4. The merchandise chute shield according to 3 where the coin discharge guide is generally planar, substantially triangular and includes a wall rising for a select distance along the third edge.

5. The merchandise chute shield according to 4 further comprising means for securing the chute shield to the merchandise chute.

6. The merchandise chute shield according to 5 where the chute shield securing means is a tang adapted to frictionally engage one edge of the underlying merchandise chute along the more vertical portion thereof.

7. The merchandise chute shield according to 4 where the angle of decent of the coin guide from the second shield portion is about 30° and the wall does not protrude above the plane of the second section.

8. The method of guiding the discharge of a coin in a coin actuated vending machine by using the merchandise chute shield of claim 1.

9. In combination:

a merchandise chute configured to communicate merchandise from the hopper of a coin operated bulk vending machine to an opening in the base thereof underlying a coin receiving mechanism disposed in the face of the base, the merchandise chute defining a bent, bifurcated, generally U-shaped channel with side walls projecting from the floor of the channel to an open front and top;

a chute cover for shielding the merchandise chute, said chute cover including a means for seating over the opening of the merchandise chute and frictionally engaging the side walls of said chute; a first section adapted to enclose a first portion of said bifurcated channel, a second section formed integrally with and along one edge of said first section, extending at an obtuse angle therefrom, and a third section sharing a common edge with each of said first and second sections respectively, and being disposed at an obtuse angle relative to said first section and an acute angle relative to said second section, said third section comprising a coin discharge guide;

where said coin discharge guide directs coins falling thereon toward the said one edge of the second section.

10. The combination of claim 9 further comprising acutely angled lip portions extending from selected edges of said first and second portions to frictionally engage the merchandise chute and positionally stabilize the shield thereon.

11. The combination of claim 10 where the chute cover is formed of molded plastic resin and further comprising a tab for interlocking the first section with one edge of the chute.

12. The method of guiding the discharge of a coin in a coin actuated vending machine by using the combination of the merchandise chute and chute cover of claim 9.

13. A merchandise chute shield for a coin-operated vending machine, comprising:

a first and a second surface elements, said first surface element lying in a first, substantially vertical plane and said second surface element lying in a second plane which intersects the first plane at an obtuse angle, said first and second surface elements being connected; and a coin discharge guide formed integrally with and establishing a portion of said second surface element and defining at least one edge of said second surface element, said coin discharge guide being disposed at an obtuse angle relative to said first surface element and declining from said second surface element at an acute angle;

where said coin discharge guide directs coins falling thereon toward the said one edge of the second surface element.

14. The chute shield according to claim 13 where the coin discharge guide is connected to the first surface element.

15. The chute shield according to claim 14 where the first and second surface elements incorporate means for attaching the shield to the underlying merchandise chute.

16. The chute shield according to claim 15 where the means for attaching includes a tang member for frictionally engaging the merchandise chute.

17. The shield according to claim 16 being stamped from metal.

18. A coin operated bulk vending machine, comprising:

a) a base;

b) a merchandise container, set on and above said base;

c) a merchandise wheel disposed between said base and said container for selecting a discrete quantity of merchandise to be dispensed upon operation of said machine;

d) a coin receiving mechanism disposed on and set into said base operably connected to the merchandise wheel;

e) a merchandise chute with a raceway having generally U-shaped cross-section for communicating said discrete quantity of merchandise from said merchandise wheel to an opening contained within said base, said merchandise chute being seatingly disposed in said base and extending behind and below said coin receiving mechanism in over-and-under arrangement; and f) and a chute shield having a first vertical shield cover portion, said first shield cover portion lying in a first, substantially vertical plane and defining an upper edge, two oppositely disposed side edges, and a lower edge;

a second shield cover portion element said second shield portion lying in a second plane which intersects the first plane at said lower edge at an obtuse angle, a coin discharge guide lying in a third plane disposed at a different angle than said first and second planes, said coin discharge guide having a first, a second, an a third edge, said first guide edge abutting the lower edge of said first shield guide and a second guide edge joining the second shield portion, said coin discharge guide defining a planar element descending from the second plane at an acute angle.

19. The method of guiding the discharge of a coin in a coin actuated vending machine by using the merchandise chute shield of claim 18.

* * * * *